US007116792B1

(12) United States Patent
Taenzer et al.

(10) Patent No.: US 7,116,792 B1
(45) Date of Patent: Oct. 3, 2006

(54) DIRECTIONAL MICROPHONE SYSTEM

(75) Inventors: Jon C. Taenzer, Los Altos, CA (US); Roman E. Roginsky, Redwood City, CA (US)

(73) Assignee: GN Resound North America Corporation, Redwood City, CA (US)

( * ) Notice: Subject to any disclaimer, the term of this patent is extended or adjusted under 35 U.S.C. 154(b) by 1160 days.

(21) Appl. No.: 09/610,188

(22) Filed: Jul. 5, 2000

(51) Int. Cl.
*H04R 25/00* (2006.01)

(52) U.S. Cl. ..... 381/313; 381/92; 381/357

(58) Field of Classification Search ..... 381/92, 381/313, 356, 357
See application file for complete search history.

(56) References Cited

U.S. PATENT DOCUMENTS 2,301,744 A * 11/1942 Olson ..... 381/87
3,715,500 A * 2/1973 Sessler et al. ..... 381/191
4,742,548 A * 5/1988 Sessler et al. ..... 381/92
5,029,215 A * 7/1991 Miller, II ..... 381/92
5,473,684 A * 12/1995 Bartlett et al. ..... 381/92
5,524,056 A 6/1996 Killion et al. ..... 381/68.2
5,757,933 A 5/1998 Preves et al. ..... 381/68.1
5,848,172 A * 12/1998 Allen et al. ..... 381/356
6,327,370 B1 * 12/2001 Killion et al. ..... 381/313
6,654,468 B1 * 11/2003 Thompson ..... 381/92
6,954,535 B1 * 10/2005 Arndt et al. ..... 381/60

* cited by examiner

*Primary Examiner*—Brian T. Pendleton
(74) *Attorney, Agent, or Firm*—Bingham McCutchen LLP

(57) ABSTRACT

A second-order microphone system is constructed of two null-less first-order microphone elements. The null-less first-order microphone elements prevent the degradations that occur in performance when a second-order microphone system is used at the side of a person's head.

35 Claims, 14 Drawing Sheets

ZERO – ORDER
MICROPHONE
(OMNI DIRECTIONAL)

FIRST – ORDER
MICROPHONE
DR = $\tau_D/\tau_P$

DR = 0
BIPOLAR

DR = 0.33
HYPER CARDIOID

DR = 0.55
SUPER CARDIOID

DR = 1
CARDIOID

| ELEMENT TYPE | Conventional Elements: Bipolar (Figure 8) DR=0 | Hyper-Cardioid DR=0.33 | Super-Cardioid DR=0.58 | Cardioid DR=1 | New Elements: Anti-SupCard. DR=1.73 | DR=2 | DR=2.5 | Anti-HypCard. DR=3 |
|---|---|---|---|---|---|---|---|---|
| Theoretical DI | 9.0 | 8.7 | 9.3 | 9.0 | 7.9 | 7.7 | 7.4 | 7.2 |
| 1.5 dB Element Mismatch | 5.6 | 5.4 | 2.0 | 3.2 | 5.8 | 6.1 | 6.4 | 6.5 |
| 5° Misalignment | 4.6 | 3.8 | 2.7 | 4.6 | 6.3 | 6.5 | 6.6 | 6.6 |
| 2 μs Delay Error | 3.1 | 2.6 | 1.8 | 3.0 | 5.0 | 5.4 | 5.8 | 6.0 |
| Misalignment and Delay Error Combined | 3.8 | 3.5 | 2.9 | 3.6 | 5.0 | 5.2 | 5.6 | 5.8 |

DIRECTIONAL MICROPHONE SYSTEM

BACKGROUND OF THE INVENTION

The present invention relates to directional microphone systems.

For improved pickup of sounds in the presence of ambient noise, directional microphones are quite advantageous. Directional microphones that achieve low frequency directionality are especially useful since most interfering noise energy is located at low frequencies In hearing aids, directional microphone technology can result in significant noise reduction. Typically, in hearing aid systems, the desired signal comes from the front of the user while noise tends to be ambient including a large component from the rear. In the communications field, it is important to reject noise sounds that occur in the band between 300 Hz and 1000 Hz (1 KHz). In both hearing aid and communication systems, directionality, especially low-frequency directionality, directly converts into better product efficiency.

FIGS. 1A and 1B illustrate an omnidirectional (zeroth order) microphone. An omnidirectional microphone is equally sensitive to sounds arriving from any direction. A common measure of microphone directionality is the ratio of on-axis sensitivity to the integral of sensitivity to sounds arriving from all angles. This measure is called the directionality index (DI), often expressed in decibels. An omnidirectional microphone has a DI of 1, or 0 dB.

FIGS. 2A–2F illustrates a first-order microphone. Miniature first-order microphones can be created with two omnidirectional elements and an electrical circuit, as shown in FIG. 2A. Alternatively, the first-order microphone can be created with a single pressure-gradient element using an acoustic circuit, shown in FIG. 2B, instead of the electrical circuit. FIG. 2A shows two omnidirectional microphones 20 and 22, separated by a propagation distance of $\tau_p$. The output of one of the omnidirectional microphones, omnidirectional microphone 22, is sent to a delay line 24. The output of the delay line 24 is subtracted from the output of the omnidirectional microphone 20 with combiner 26. FIG. 2B shows an acoustical first-order microphone unit. The first-order pressure-gradient element 30 includes a front sound inlet port 32, a rear sound inlet port 34, and a diaphragm 36. An acoustical delay line 38 is used to acoustically delay sound coming from one of the inlet ports. Since the sound impinges upon both sides of the diaphragm 36, pressure on one side is effectively subtracted from the pressure on the other side.

Classically, several of the first-order directionality patterns have been found to be useful and have been given names. Each pattern is produced when the internal delay, electrical or acoustic, $\tau_d$, equals a specific fraction of the free field propagation delay, $\tau_p$, for the incident sound wave to propagate from one sound inlet port to the other. For example, if the internal delay is adjusted to equal the propagation delay, the delay ratio, $DR=\tau_d/\tau_p$, is equal to 1, and the directionality pattern is the well-known cardioid pattern shown in FIG. 2F. The cardioid has a single null directly to the rear and a DI of 4.8 dB. Another classical directionality pattern is the hypercardioid, created when DR equals one-third. This pattern, shown in FIG. 2D, has two nulls, a moderate backlobe, and exhibits the best directionality index (DI=6 dB) of the first-order elements. For better rejection of sound from the rear, the supercardioid pattern is used. This pattern is created when the internal delay is set to $1/\sqrt{3}$ times the propagation delay, DR=approximately 0.58 and DI=5.7 dB. This example is shown in FIG. 2E. Another classical pattern of importance is the "figure eight" or bipolar pattern shown in FIG. 2C, which is used when low sensitivity to sounds from the sides is desired. This pattern has a DR=0 (no internal delay) and a directionality index of 4.8 dB.

All the first-order free field directionality patterns can be described with the equation $$A(\theta) = \frac{1 + (1/DR)\cos\theta}{1 + (1/DR)}$$

where θ is the angle of sound arrival relative to the forward element axis, and DR is the delay ratio. Note that as DR goes to infinity ($\tau_d$ becomes infinite), the zeroth-order omnidirectional microphone is produced.

To produce a second-order (or higher-order) microphone, two or more omni- or first-order gradient microphones are combined, with an electrical delay circuit, or with an acoustic circuit, to create an end fire directional array. In any case, the array can be considered to be a combination of first-order gradient microphone units, whether developed from omni- or pressure-gradient elements. FIG. 3A illustrates an example of a second-order microphone system constructed of two bipolar first-order microphone elements adapted from the article by Olsen, "Directional Microphones," pp. 190–194, of *An anthology of articles on microphones from the pages of the Audio Engineering Society*, Vol. 1–Vol. 27 (1953–1979). This second-order microphone system has a very high directionality pattern as shown in FIG. 3B. A theoretical directionality index of 9.0 dB is produced by this method.

Second-order microphone arrays designed using first-order microphone elements give excellent theoretical directionality patterns. Unfortunately, such second-order microphone systems have been unsuccessful when used on the side of the head, for example in a hearing aid. In all such previous second-order microphone array systems used at the side of the head, the performance of the microphone array in situ degrades to below that of a first-order microphone element, such that there is no benefit to the second-order configuration. The near-field diffraction effects that result from placing the second-order microphone next to the user's head degrade the system performance. These near-field diffraction effects cannot be adequately compensated for, especially where a single microphone design is intended for use by numerous individuals each with their own unique head shape and size, i.e. biological variability.

It is desired to have an improved microphone system for use on the side of a user's head.

SUMMARY OF THE PRESENT INVENTION

The inventors have realized that the failure of second-order microphone systems when used in hearing-aid systems is that the phase of the outputs of the first-order microphone elements changes very rapidly in the region of their nulls. Thus, even slight deviations in alignment between the elements, in signal arrival times due to diffraction effects, or in element internal delay matching due to temperature or aging drift, can produce great degradation in the second-order microphone system performance.

Unexpectedly, by combining null-less first-order microphone elements in a second-order or higher microphone system, an improved in situ performance is obtained. This is despite the fact that the theoretical performance of a second-order microphone system is much greater when classical first-order microphone elements with nulls are used.

In one embodiment, the present invention is a microphone system using two first-order microphone elements. Each of the first-order microphone elements has a finite delay ratio greater than 1. The microphone includes a combining unit operatively connected to the first-order microphone elements. The combining unit is such that the microphone system comprises a second-order or higher microphone system.

Another embodiment of the present invention is a microphone system comprising two first-order microphone elements. Each of the two first-order microphone elements has no nulls. The microphone system includes a combining unit operably connected to the two first-order microphone elements, the combining unit being such that the microphone system comprises a second- or higher-order microphone system.

In a preferred embodiment of the present invention, the two first-order microphone elements have a delay ratio in the range 1.5 to 5. Delay ratios in that range are not so low such that they exhibit null-like behavior but not so high that they exhibit omnidirectional-like behavior. In one embodiment of the present invention, the first-order microphone elements have a delay ratio in the range 1.5 to 3.

Yet another embodiment of the present invention is a method for matching the outputs of two microphone elements for use in a microphone system. This method includes providing a microphone system having two microphone elements, each of the microphone elements oriented having a front and back direction, the output of the two microphone elements being greater for sounds coming from the front direction than from the back direction. The method further includes providing a test sound to the two microphone elements, the test sound coming preferentially from the back direction, and using the output of the two microphone elements during the sound test to match the two microphone elements.

Prior methods which matched microphone elements for microphone systems used an ambient sound with no directionality, or a sound coming from the front. The inventors realized that for second-order microphone systems, matching the output of the microphone elements from the back is much more important than matching the output from the front. This is because in the second-order microphone system, the outputs from the rear are effectively subtracted from one another. This means that a relatively small mismatch in rear output can result in a high total output error. The matching method of the present invention can be used with conventional microphone element matching in which compatible microphone elements are paired up for use in a system, or it can be used in a matching method in which matching filter coefficients are determined for a digital system.

DETAILED DESCRIPTION OF THE PREFERRED EMBODIMENT

Figure 1A:
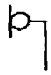
Figure 1A (Prior Art)
FIG. 1A is a diagram of a prior-art omnidirectional microphone.
Figure 1B:
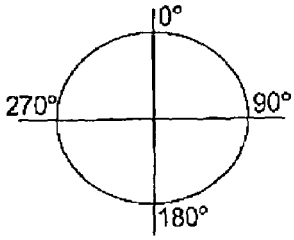
Figure 1B (Prior Art)
FIG. 1B is a diagram of the output of the omnidirectional microphone of FIG. 1A with respect to input direction.
Figure 2A:
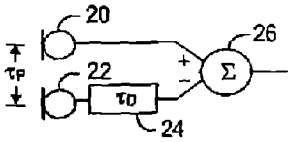
Figure 2A (Prior Art)
FIG. 2A illustrates a prior-art first-order microphone comprised of two omnidirectional microphones and a delay.
Figure 2B:
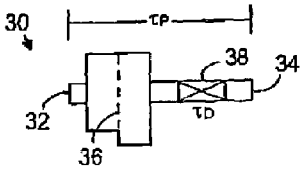
Figure 2B (Prior Art)
FIG. 2B is a diagram of a prior-art acoustical first-order microphone.
Figure 2C:
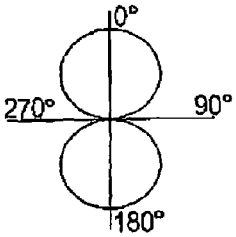
Figure 2C (Prior Art)
FIGS. 2C–2F are diagrams that illustrate the output with respect to input angle of first-order microphones for different delay ratios.
Figure 2D:
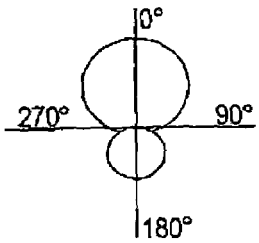
Figure 2D (Prior Art)
Figure 2E:
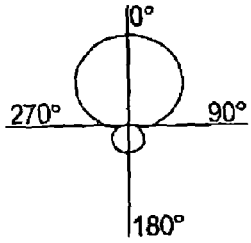
Figure 2E (Prior Art)
Figure 2F:
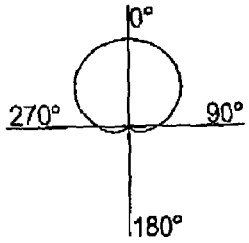
Figure 2F (Prior Art)
Figure 3A:
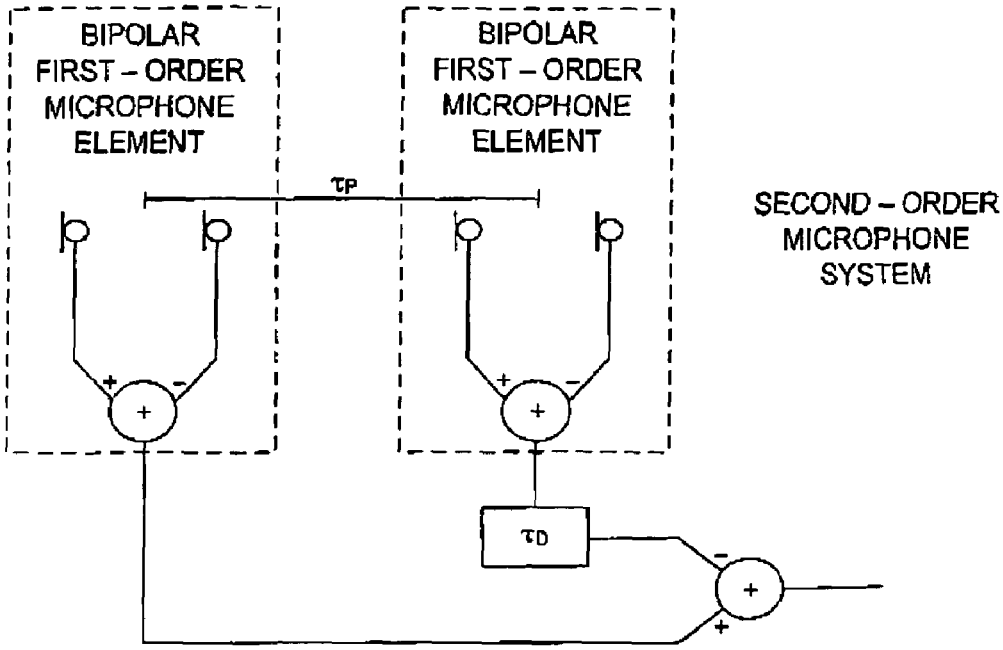
Figure 3A (Prior Art)
FIG. 3A is a prior-art diagram of a second-order microphone system comprised of two bipolar first-order microphone elements.
Figure 3B:
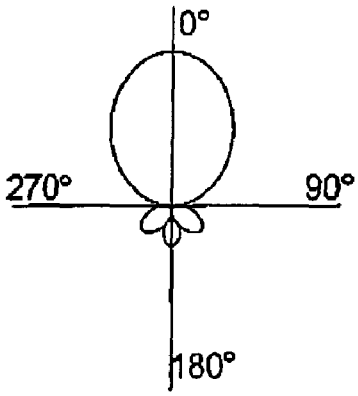
Figure 3B (Prior Art)
FIG. 3B is a diagram illustrating the output of the second-order microphone system with respect to input angle.
Figure 4A:
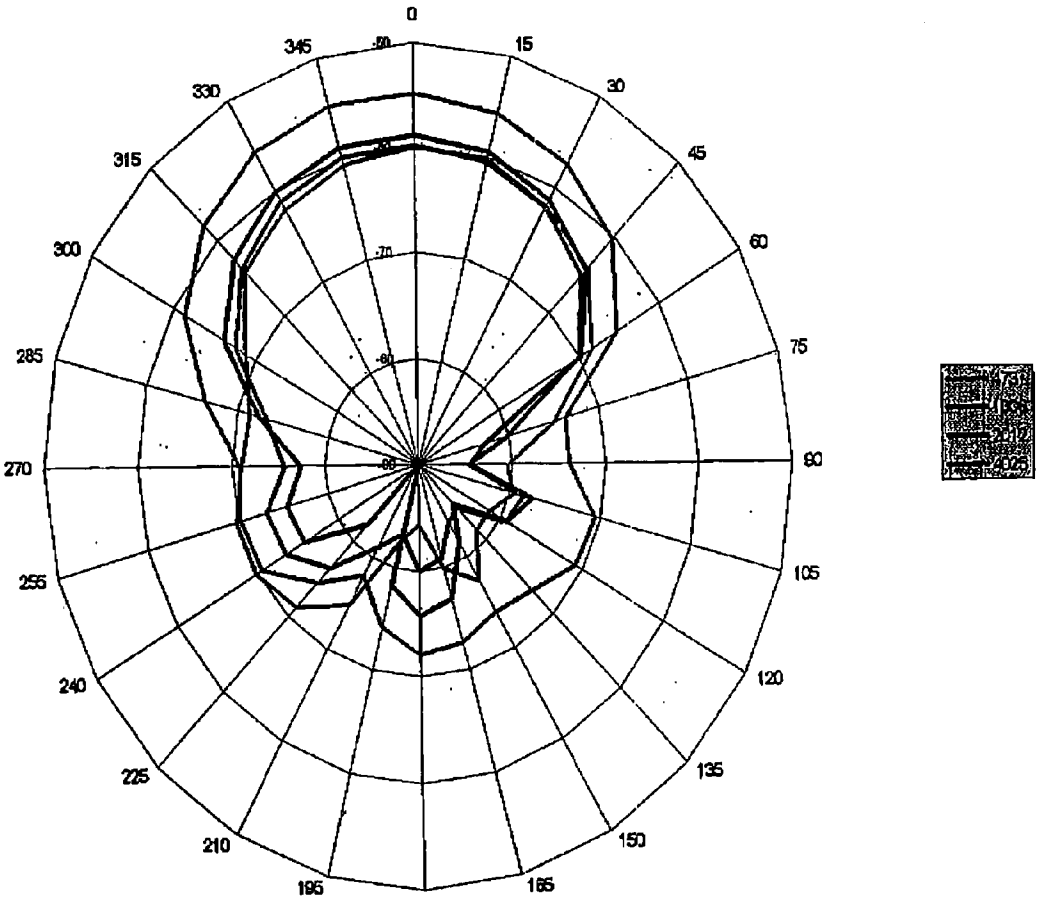
FIG. 4A is a diagram illustrating the output with respect to input angle of a second-order microphone system placed in a free field, the second-order microphone system constructed from classical first-order microphone units.

FIG. 4A is a polar plot of the free-field output of a second-order microphone constructed of classical first-order microphone elements. Note that quite good directionality is produced under these conditions.

Figure 4B:
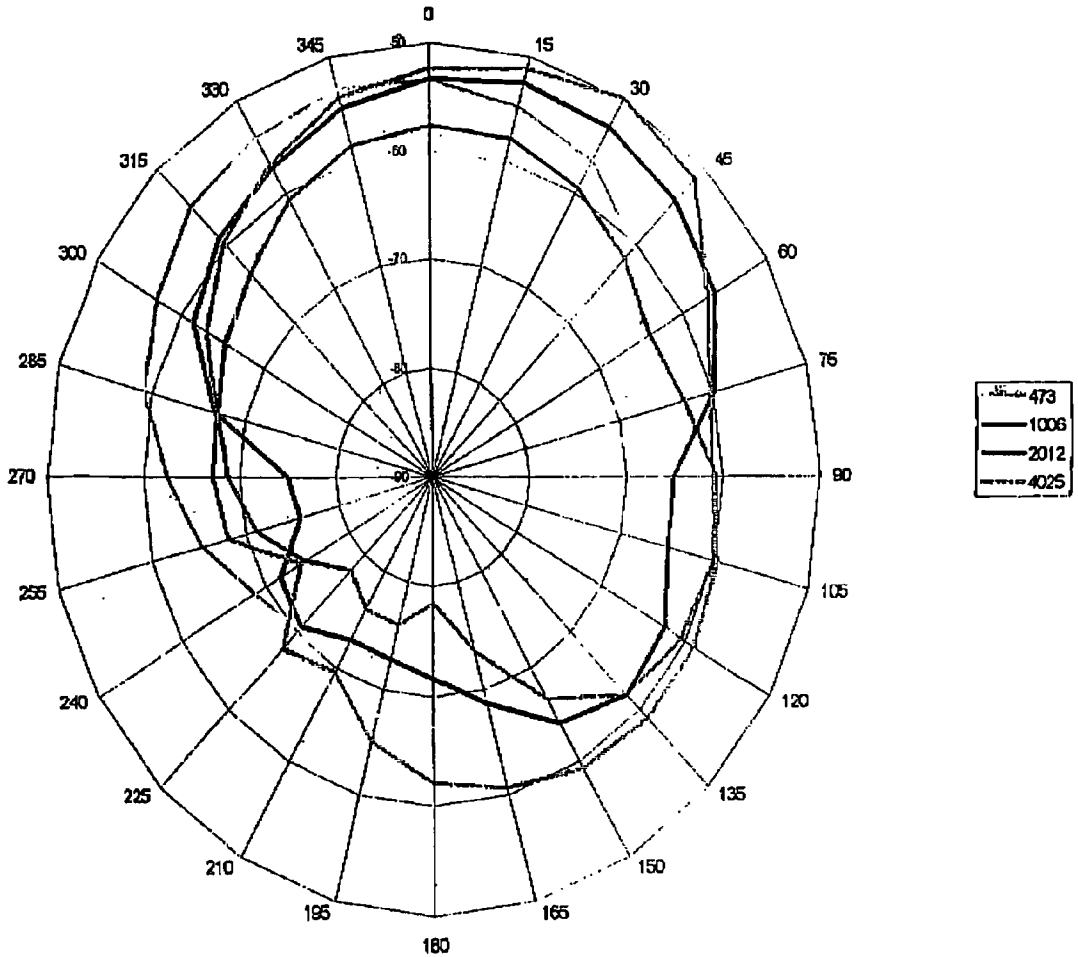
FIG. 4B is a diagram of the output of the microphone system of FIG. 4A when placed in situ, e.g. adjacent to a user's head.

FIG. 4B is a polar plot diagram that illustrates the output of the system of FIG. 4A when placed adjacent to a user's head. Due to diffraction effects, the directionality of the microphone degrades severely. The applicants have discovered that this degradation is a result of the use of classical first-order microphone elements which have nulls. Even slight deviations in the mechanical elements, signal arrival times due to diffraction effects, element internal delay matching due to temperature or aging drift, etc., produce large degradations in the second-order microphone system performance.

Figure 5:
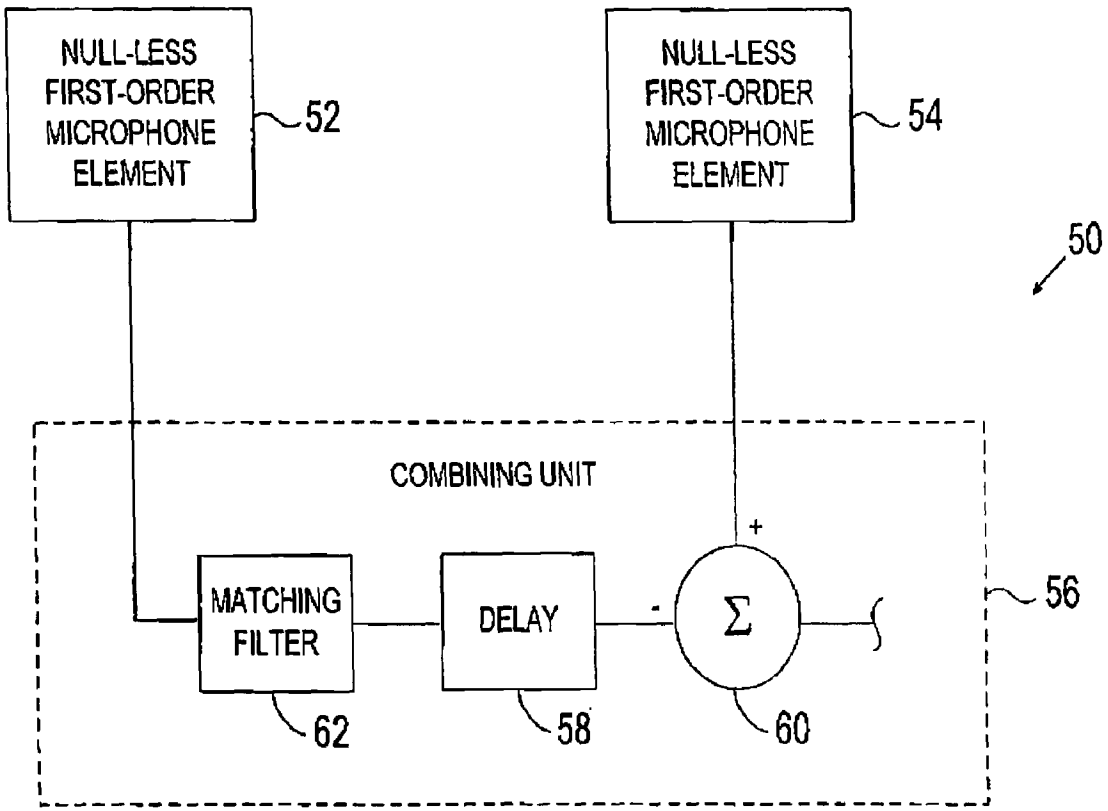
FIG. 5 is a diagram illustrating a microphone system of the present invention.

As shown in FIG. 5, the second-order microphone system of the present invention uses null-less first-order microphone elements 52 and 54. The null-less first-order microphone elements have a relatively poor DI, and for that reason have not been used in second-order microphone systems in the past. Prior second-order microphone elements used classical first-order elements in their construction. This is logical because the classical first-order microphone elements when used in a second-order microphone system produce a second-order microphone system with a higher theoretical DI than a second-order microphone system constructed of the null-less first-order microphone elements.

As shown in FIG. 5, the output of the null-less first-order microphone elements 52 and 54 are sent to a combining unit. The combining unit can include delay 58 and summing unit 60. A matching filter 62 is typically used to match the outputs of the first-order microphone elements. The delay 58 is selected such that the output of the second-order microphone has the highest possible DI.

Figure 6:
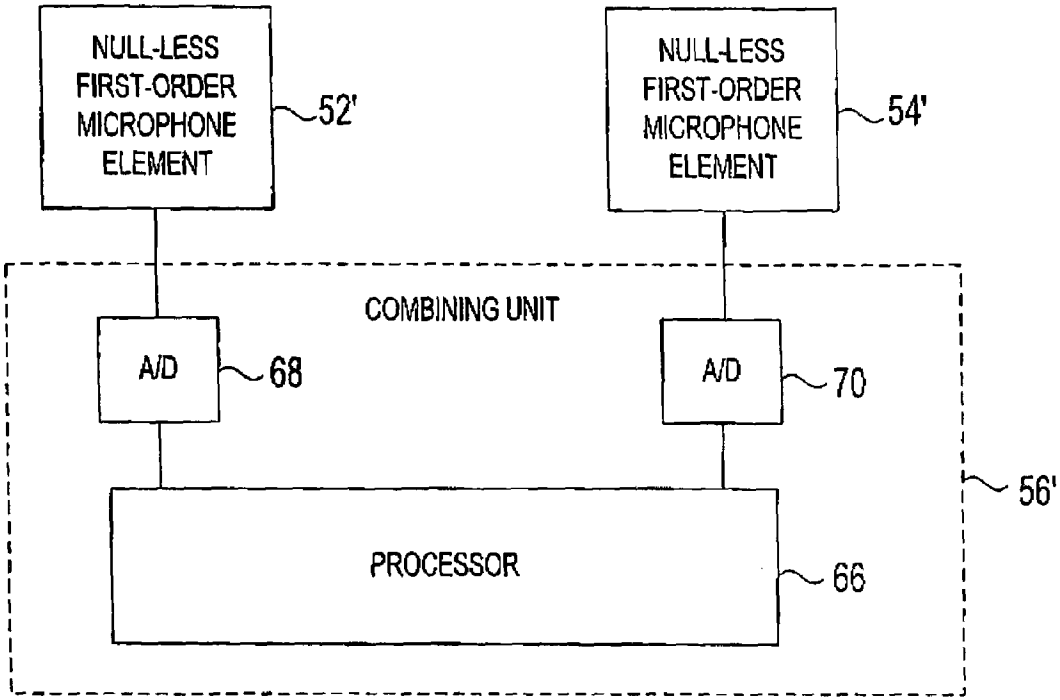
FIG. 6 is a diagram of an alternate microphone system of the present invention using a processor to implement some functions.

FIG. 6 illustrates the system when the combining unit comprises a processor 66. The output of the null-less microphone elements 52' and 54' are sent to analog-to-digital conversation units 68 and 70. The processor implements algorithms to do the delaying, combining and matching operations of the system of FIG. 5.

In a preferred embodiment, the null-less first-order microphone elements are implemented as acoustical first-order microphone elements. This reduces the amount of microphone element output matching that is required. The acoustical microphone elements of the present invention are preferably constructed by reducing the distance between the two inlet ports of an acoustical first-order microphone element from that of the classical acoustical first-order elements. This is typically simpler than the alternate approach of increasing the value of the acoustical delay line, although that is included here as an alternative approach to achieving the invention.

Figure 7:
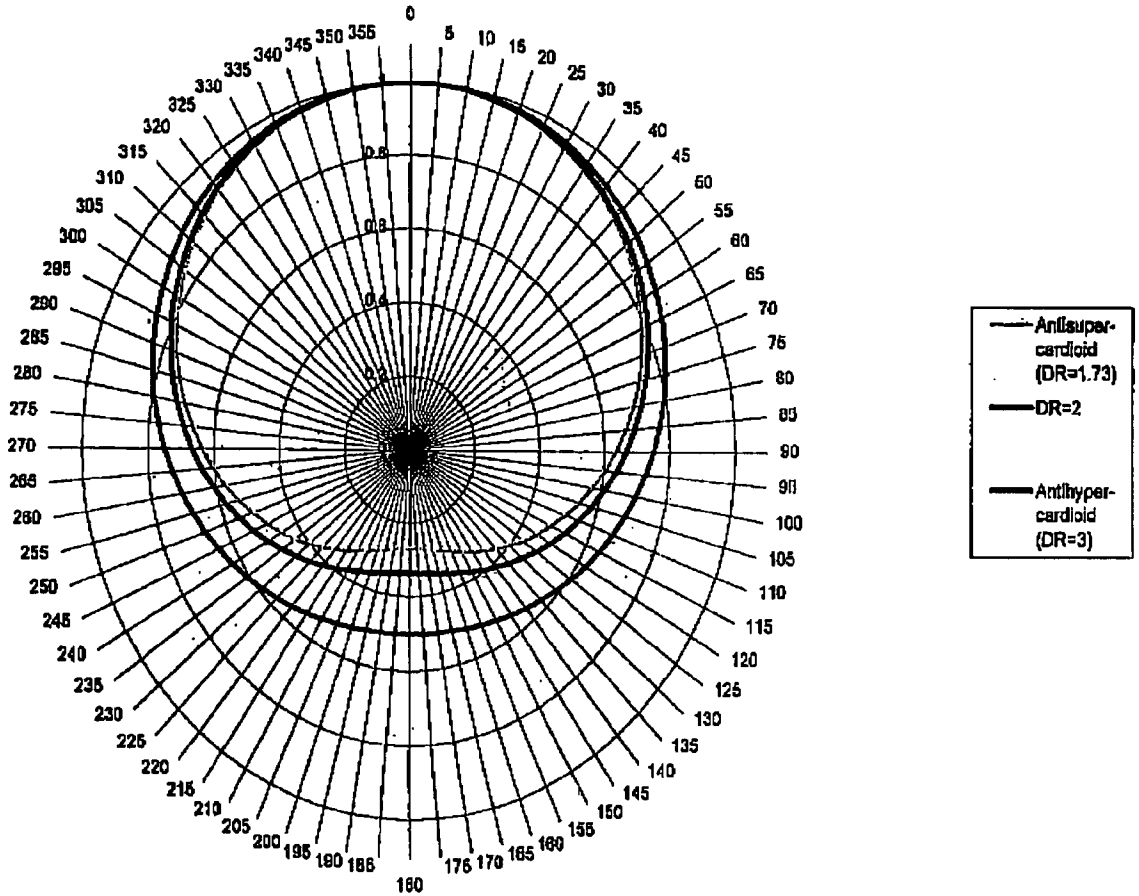
FIG. 7 is a diagram that illustrates the output of the first-order null-less microphone units used to construct the second-order microphone system of the present invention.

FIG. 7 illustrates the polar directionality patterns for three of the null-less first-order elements. Null-less microphone elements with delay ratios greater than one have low DI values and thus have been ignored in the past. Although these elements have been known for a while, there hasn't been a good use for them. As a result of the lack of interest in these patterns, these patterns have not been given any names. The applicants have discovered that these elements exhibit the desired gradual phase change needed to make higher-order microphone array systems robust. The applicants have titled the null-less first-order element with the delay ratio equal to $\sqrt{3}$, approximately 1.73, the Antisupercardioid (since its DR value is the inverse of the DR value for the Supercardioid), and titled the null-less first-order microphone element with DR equal to 3 the AntiHyperCardioid (since its DR is the inverse of the DR of the Hypercardioid).

First-order microphone elements with DRs greater than one produce the desired effect. The applicants have found that null-less first-order elements with DRs in the range of 1.5 to 5, and more preferably 1.5 to 3, are most suitable for use in a second-order microphone system. Below 1.5 the second-order microphone system constructed becomes too sensitive; above about 3 or 5, the array does not achieve significant benefit over that of a single optimized first-order element.

FIG. 7 illustrates a polar directionality pattern for three of the new null-less first-order elements: The Antisupercardioid first-order element; a first-order element with a DR equal to 2; and the AntiHyperCardioid. As shown, there are no nulls in these patterns, yet they exhibit good front-to-back ratios.

Figure 8A:
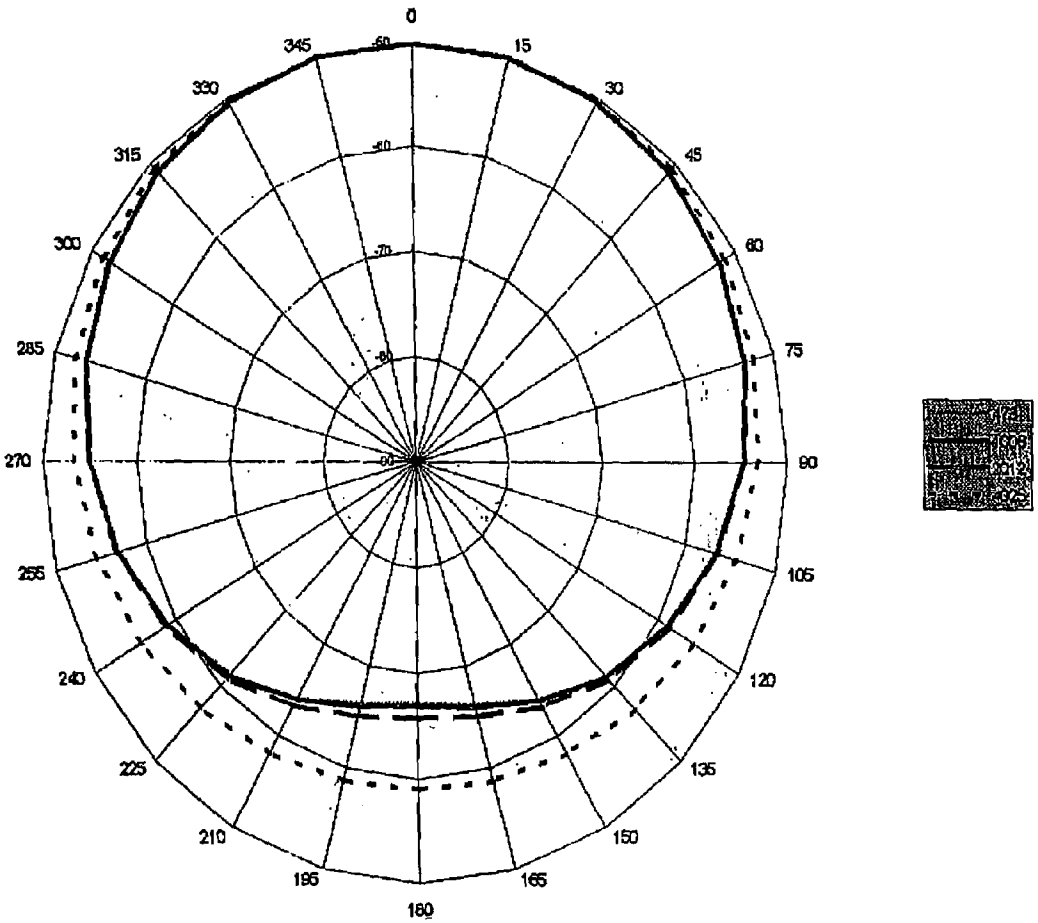
FIG. 8A is a diagram that illustrates the output of a first-order microphone element used in one embodiment of the present invention.
Figure 8B:
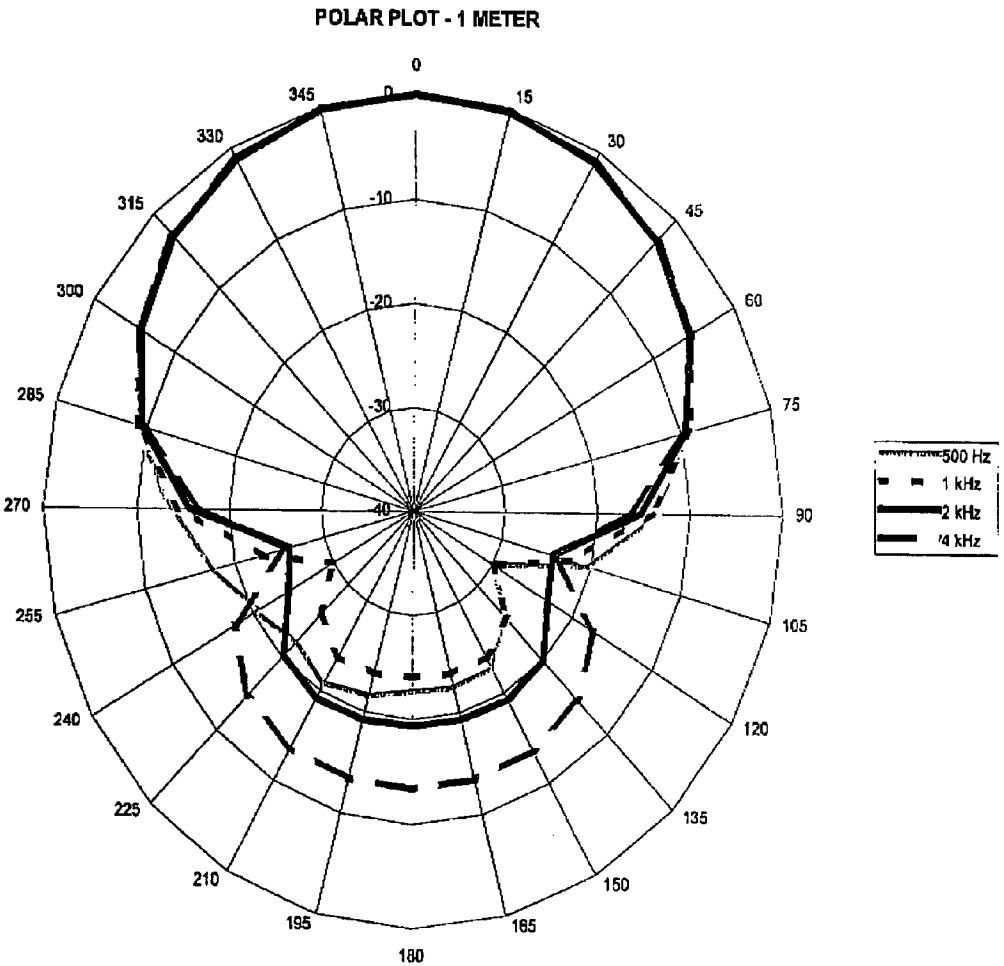
FIG. 8B is a diagram that illustrates a free field response of a second-order microphone system constructed using two first-order microphone elements having the response pattern of FIG. 8A.
Figure 8C:
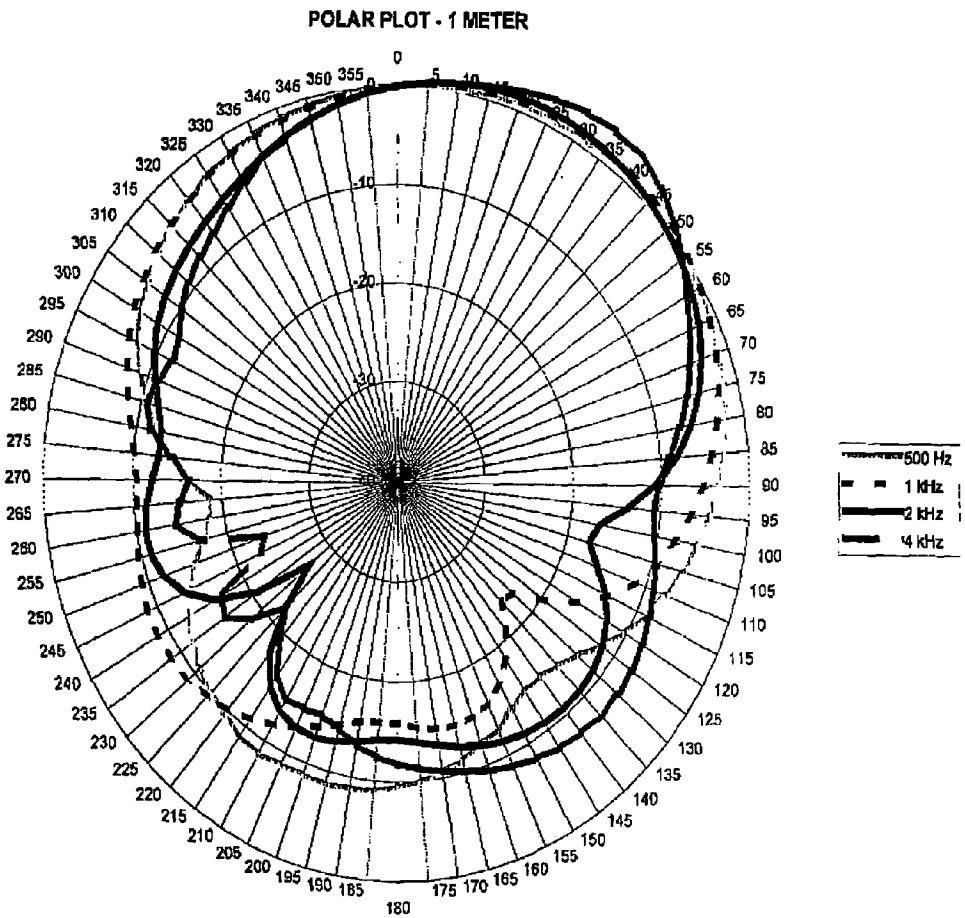
FIG. 8C is a diagram of the in situ response of the second-order microphone system of FIG. 8B.

FIG. 8A illustrates a polar directionality pattern for a first-order element at different frequencies. FIG. 8B illustrates the polar directionality output for a second-order microphone system constructed of two of the microphones of the directionality pattern of FIG. 8A in the free field. FIG. 8C is a polar plot which illustrates the polar directionality pattern for the second-order microphone of FIG. 8B when it is placed in situ, e.g. adjacent to a user's head. Note that the second-order microphone system shown in FIG. 8B does not degrade much when it is placed against the user's head. The system illustrated in FIG. 8C is quite robust.

Figure 9A:
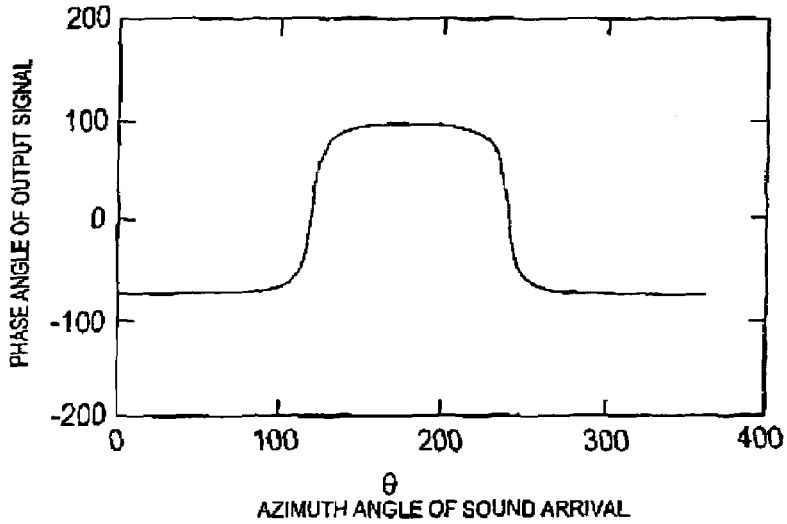
FIG. 9A illustrates the phase output response with respect to sound arrival angle for a supercardioid first-order microphone.
Figure 9B:
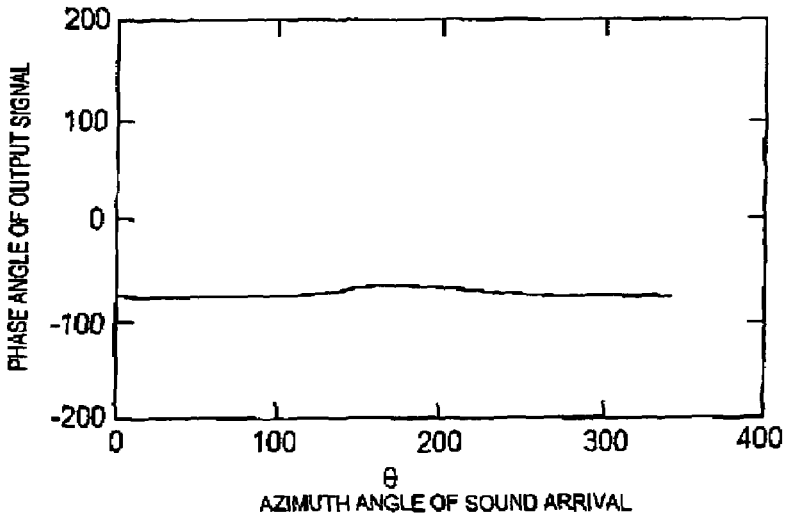
FIG. 9B illustrates the phase angle as a function of sound arrival angle for the first-order antisupercardioid element used in the present invention.

FIG. 9A is a diagram illustrating the output signal phase as a function of sound arrival angle for a microphone with a supercardioid pattern. Note that the phase changes quite abruptly at approximately 120 and 240 azimuthal degrees. By contrast, FIG. 9B illustrates the output signal phase as a function of sound arrival angle for the antisupercardioid pattern of a null-less first-order element used in the present invention. Note that the phase change is quite small and gradual, i.e. there are no large, abrupt changes. The effect of angle mismatch for the phase of the supercardioid pattern of FIG. 9A is illustrated with respect to FIG. 10.

Figure 10:
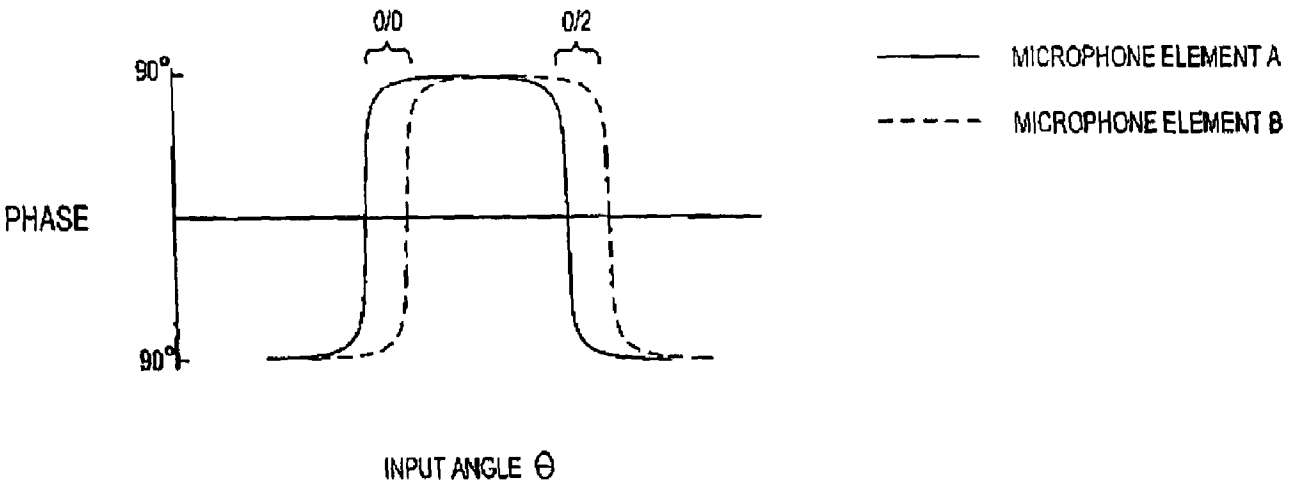
FIG. 10 illustrates the effect of phase mismatch for two classical first-order elements used in a second-order system.

FIG. 10 illustrates the signal phase of the signals from two microphone elements which have a slight sound arrival angle offset which may be the result, for example, of diffraction effects near the head or normal manufacturing variations. Note that in the regions 90 and 92, there is a 180° phase change between the outputs of the two microphone elements. These regions 90 and 92 are located about the nulls of the supercardioid patterns. The 180° phase difference between the microphone elements' outputs often results in an unwanted microphone reception peak at the angles of the nulls in the first-order microphone elements because the 180° phase shift difference reverses the operation of the subtraction in the combiner and turns it into an adder in the region where the 180° phase difference occurs. As can be imagined, this does not occur for systems using the antisupercardioid pattern illustrated with respect to FIG. 9A, because the phase change is quite small and, thus, the phase difference is also small.

Figures 11, 12:
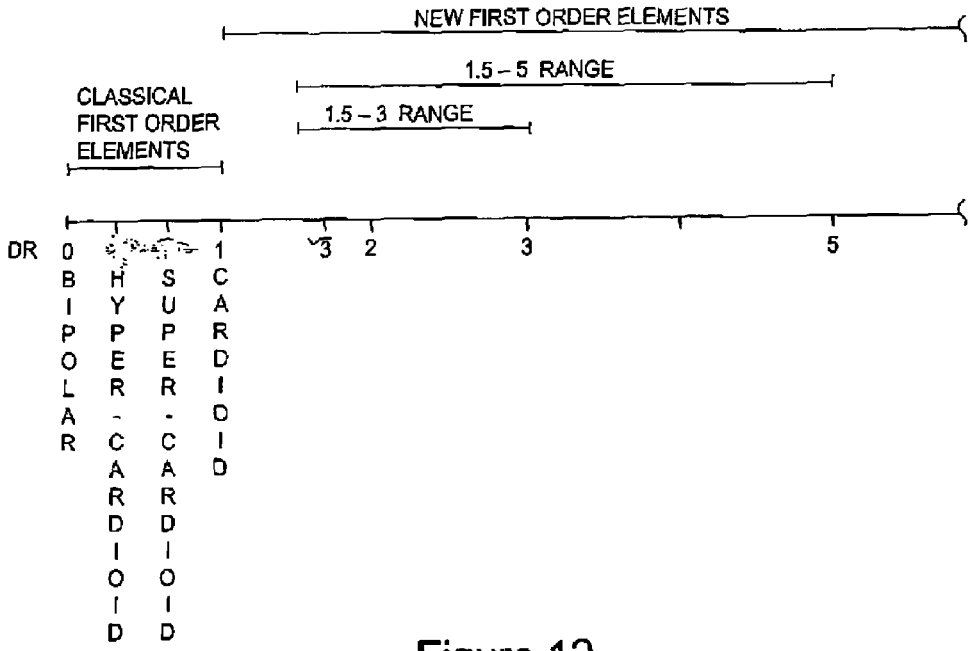
FIG. 11 is a table that illustrates the theoretical and actual performance for second-order microphone systems comprising multiple first-order elements.
FIG. 12 is a diagram that illustrates the classical first-order elements and the null-less first-order elements which are used with the second-order microphone systems of the present invention.

FIG. 11 is a table that compares the theoretical and real-world 500 Hz performance of second-order arrays both constructed from classical elements and constructed with the new null-less first-order elements. The theoretical free-field DIs for the second-order system constructed of classical first-order devices exceeds those of the second-order microphone system constructed from the null-less first-order elements. However, when simulated with the realistic tolerance and environmental variations, the directivity index of the second-order array constructed with classical first-order elements rapidly degrades, usually below that of a simple first-order element. This is why second-order microphone arrays have not been successful when situated on the side of a user's head. Note that the second-order microphone arrays constructed of the new null-less first-order elements are quite robust, and continue to maintain DIs above those of even the best first-order elements under very adverse conditions.

FIG. 12 illustrates the delay ratios of first-order elements. Delay ratios in the range of 0 to 1 produce the classical first-order elements. The new null-less first-order elements used in the system of the present invention range from 1 and above. Note that a zero-order element would effectively have a DR value of infinity, so that the null-less first-order elements of the present invention effectively can be described as having a finite DR value greater than 1.

Another embodiment of the present invention relates to the matching of the outputs of the microphone elements used to construct a microphone array. Microphone arrays typically use some form of microphone element sensitivity-matching. In some cases, particularly well-matched microphones are selected from a large number of microphone elements and are provided by the manufacturer. The manufacturer typically produces the microphone elements and then matches them up such that they have good amplitude response matching over a range of frequencies useful for the particular application, for example, from 200 Hz to 5 or 6 kHz for hearing-aid applications. Another way of matching the microphone outputs is to use a matching filter. Such a matching filter can easily be implemented in a digital embodiment. In one embodiment, the two microphone elements are matched using software loaded into the processor.

In prior microphone-element-matching systems, the sound signal used for the test was either omnidirectional (coming from all directions), or the sound came from the front axis of the microphone elements. The applicants have discovered that it is best to match microphone elements for back sensitivity. This is the opposite of the conventional understanding, but it improves the robustness of the microphone system.

In second-order microphone systems, the signals from the two first-order elements are subtracted after being delayed. Good directionality results from the efficient rejection of sound from the rear. Therefore it is most important that the individual elements' directionality pattern toward the rear is made as matched as possible. Matching the back sensitivity of the elements can also guarantee that the rear pattern is stable over the manufacturing tolerances and excellent DI stability results. It is less crucial that the front sensitivities be matched up, since in effect the sensitivities are added together in the second-order system.

A simple example which illustrates this point will assume a 3 dB (−30%) sensitivity mismatch for the two elements used for constructing a second-order microphone system. In the forward direction the two sensitivities are essentially added, i.e. 130% plus 100%=230%, illustrating that the forward array sensitivity is upset by just 15% or 1.5 dB by the 3 dB forward sensitivity mismatch. However, in the rear direction the sensitivities are essentially subtracted, i.e. 130%–100%=30%. Thus, the rearward rejection, which should be an infinite number of decibels, is reduced to only 10 dB, i.e. an infinite reduction in back rejection.

Figure 13:
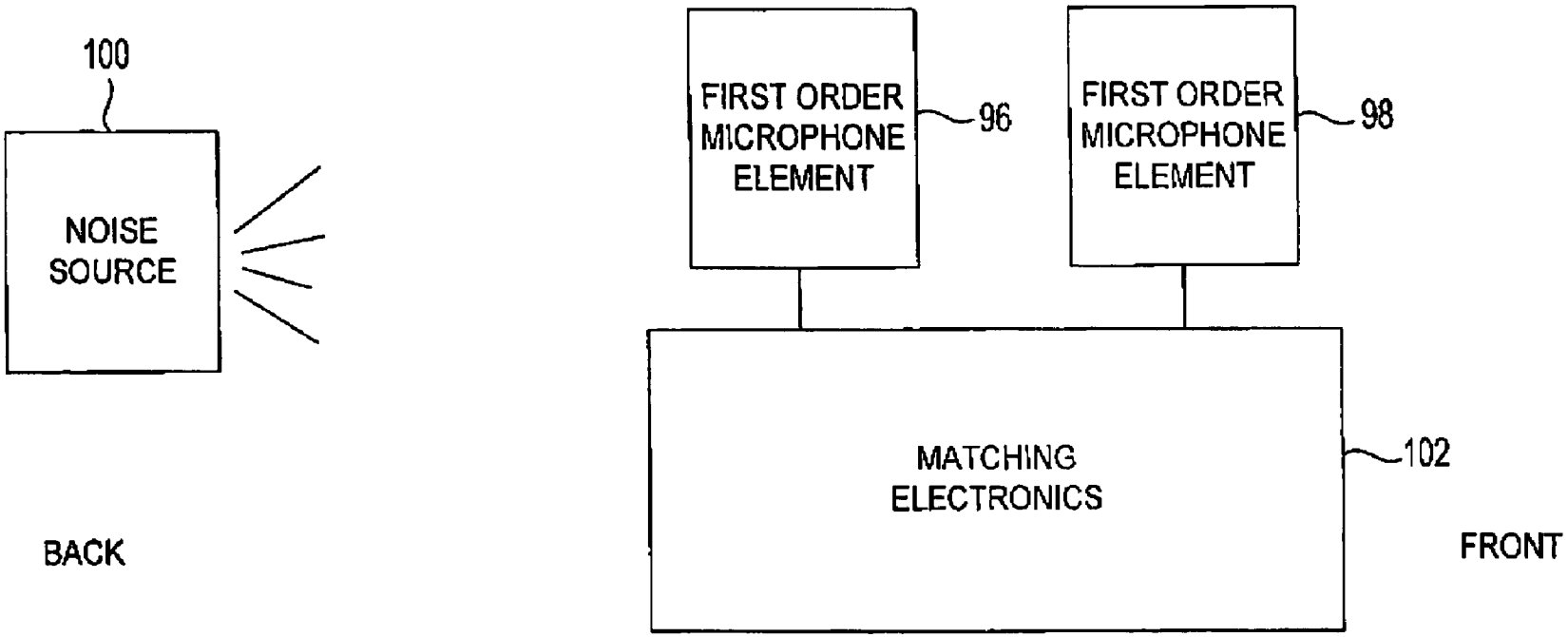
FIG. 13 is a diagram that illustrates the sensitivity matching of two first-order microphone elements.

FIG. 13 is a diagram that illustrates the sensitivity matching of two first-order microphone elements 96 and 98. The first-order elements typically define a front axis and a rear axis as can be seen with respect to FIG. 7. A sound signal source 100 is positioned at the rear axis of the two first-order microphone elements 96 and 98. The matching electronics 102 can be a processor which tests the outputs of the two first-order microphone elements 96 and 98 in response to the sound signal source 100 at the rear. In one embodiment, the sound signal source 100 varies its frequency such that a matching filter's values can be constructed for different frequency ranges or bins. A matching filter can thus be constructed. In one embodiment, the matching electronics 102 is a digital signal processor loaded with testing software to determine the matching filter values. These matching filter values can then be stored by the processor for later use in a digital microphone system.

An alternate method individually tests and measures each element's rearward sensitivity, and then elements are selected based upon the similarity of their individual measured sensitivities. This method is much like the method used today by microphone manufacturers to match the sensitivities of omni-directional microphone elements in order to supply a matched pair, but differs in that first-order elements are being matched and that the matching is being done for the rearward sensitivity of those elements.

Although the above description has been given with respect to second-order microphone system, higher-order microphone array systems constructed with the null-less first-order microphone systems of the present invention can also be constructed. The lack of nulls in the first-order microphone elements aids in the operation of the higher-order microphone arrays as well.

It will be appreciated by those of ordinary skill in the art that the invention can be implemented in other specific forms without departing from the spirit or central character thereof. The presently disclosed embodiments are therefore considered in all respects to be illustrative and not restrictive. The scope of the invention is indicated by the appended claims rather than the foregoing description, and all changes which come within the meaning and range of equivalents thereof are intended to be embraced herein. Accordingly, the above description is not intended to limit the invention, which is to be limited only by the following claims.

The invention claimed is:

1. A microphone system comprising:

two first-order microphone elements, each of the first-order microphone elements having a finite delay ratio (DR) greater than one, and a combining unit operably connected to the two first-order microphone elements, wherein the combining unit is such that the microphone system comprises a second- or higher-order microphone system, wherein the microphone system is adapted for positioning near a diffractive body.

2. The microphone system of claim 1 wherein the diffractive body is a human body part.

3. The microphone system of claim 2 wherein the human body part is a human head.

4. The microphone system of claim 1 wherein the first-order microphone elements are acoustic first-order microphone elements.

5. The microphone system of claim 1 wherein the first-order microphone elements each use two omnidirectional microphones.

6. The microphone system of claim 1 wherein the delay ratio is in the range of 1.5 to 5.

7. The microphone system of claim 6 wherein the delay ratio for each of the first-order microphone elements is in the range 1.5 to 3.

8. The microphone system of claim 1 wherein the combining unit implements a delay and a subtraction.

9. The microphone system of claim 8 wherein the combining unit further implements a matching function.

10. The microphone system of claim 1 wherein the combining means comprises a programmed processor.

11. The microphone system of claim 1 wherein the microphone system is adapted to be positioned on a user's head.

12. The microphone system of claim 11 wherein the microphone system is part of a hearing aid.

13. The microphone system of claim 11 wherein the microphone system is part of a communication system.

14. A microphone system comprising:

two first-order microphone elements, each of the first-order microphone elements having no nulls, and a combining unit operable connected to the two first-order microphone elements, wherein the combining unit is such that the microphone system comprises a second- or higher-order microphone system.

15. The microphone system of claim 14, wherein the delay ratio for each of the first-order microphones is in the range 1.5 to 5.

16. The microphone system of claim 14, wherein the delay ratio for each of the first-order microphone elements is in the range 1.5 to 3.

17. The microphone system of claim 14, wherein the combining means includes a delay function and a subtraction function.

18. The microphone system of claim 14, wherein the combining means further includes a matching function.

19. The microphone system of claim 14, wherein the combining means comprises a programmed processor.

20. The microphone system of claim 14 wherein the microphone system is part of a communication system.

21. The microphone system of claim 14 wherein the microphone system is used on the human head.

22. A microphone system comprising:

two first-order microphone elements, each of the first-order microphone elements having a delay ratio (DR) in the range 1.5 to 5, and a combining unit operable connected to the two first-order microphone elements, wherein the combining unit is such that the microphone system comprises a second- or higher-order microphone system.

23. The microphone system of claim 22, wherein each of the first-order microphone elements has a delay ratio in the range 1.5 to 3.

24. The microphone system of claim 22, wherein the combining means comprises delay and subtraction functional units.

25. The microphone system of claim 22, wherein the combining means further comprises a matching unit.

26. The microphone system of claim 22, wherein the combining means comprises a programmed processor.

27. The microphone system of claim 22 wherein the microphone system it is used on the human head.

28. A method of matching the outputs of two microphone elements for use in a microphone system, comprising:

providing a microphone system having two microphone elements, each of the microphone elements oriented having a front and back direction, the output of the two microphone elements being greater for sounds coming from the front direction than from the back direction;

providing a test sound to the two microphone elements, the test sound coming preferentially from the back direction; and using the output of the two microphone elements during the sound test to match the two microphone elements.

29. The method of claim 28, wherein the two microphone elements are first-order microphone elements.

30. The method of claim 29, wherein the first-order microphone elements have a delay ratio in the range 1.5 to 3.

31. The method of claim 29, wherein the two microphone elements are null-less first-order microphone elements.

32. The method of claim 28, wherein the two microphone elements are operatively connected to a processor system which is used to do the matching tasks.

33. The method of claim 32, wherein the processor constructs a digital matching filter to match the outputs of the two microphone elements.

34. The method of claim 33, wherein the digital matching filter is used by the processor in the operation of a microphone system constructed of the two microphone elements.

35. The method of claim 28, wherein microphone elements are individually tested and microphone elements with matching responses are paired up.

* * * * *